US009285187B2

(12) United States Patent
Stockdill

(10) Patent No.: US 9,285,187 B2
(45) Date of Patent: Mar. 15, 2016

(54) RETICLE PIECE HAVING LEVEL INDICATING DEVICE

(71) Applicant: Lightforce USA, Inc., Orofino, ID (US)

(72) Inventor: Kevin Stockdill, Orofino, ID (US)

(73) Assignee: Lightforce USA, Inc., Orofino, ID (US)

( * ) Notice: Subject to any disclaimer, the term of this patent is extended or adjusted under 35 U.S.C. 154(b) by 196 days.

(21) Appl. No.: 14/039,260

(22) Filed: Sep. 27, 2013

(65) Prior Publication Data

US 2014/0090259 A1 Apr. 3, 2014

Related U.S. Application Data

(60) Provisional application No. 61/708,731, filed on Oct. 2, 2012.

(51) Int. Cl.
*F41G 1/467* (2006.01)
*F41G 1/12* (2006.01)
*F41G 1/44* (2006.01)

(52) U.S. Cl.
CPC ... *F41G 1/12* (2013.01); *F41G 1/44* (2013.01)

(58) Field of Classification Search
CPC ..... G02B 27/32; F41G 1/12; F41G 1/44
USPC ..... 33/297, 298, 354; 42/122, 130, 135
See application file for complete search history.

(56) References Cited

U.S. PATENT DOCUMENTS

| | | | | |
|---|---|---|---|---|
| 1,955,746 A | | 4/1934 | Inglis | |
| 2,094,623 A | | 10/1937 | Stokey | |
| 2,420,253 A | * | 5/1947 | Land | 33/276 |
| 2,580,280 A | * | 12/1951 | Bullard | 33/298 |
| 3,381,380 A | * | 5/1968 | Thomas | 33/297 |
| 3,556,666 A | * | 1/1971 | Lichtenstein | 42/123 |
| 5,223,650 A | | 6/1993 | Finn | |
| 5,657,571 A | * | 8/1997 | Peterson | 42/122 |
| 5,920,995 A | * | 7/1999 | Sammut | 42/122 |
| 6,978,569 B2 | | 12/2005 | Williamson, IV et al. | |
| 7,296,358 B1 | | 11/2007 | Murphy et al. | |
| 7,530,193 B2 | | 5/2009 | Williamson, IV et al. | |
| 8,069,577 B1 | | 12/2011 | Willman et al. | |
| 8,286,383 B2 | | 10/2012 | Matthews | |

FOREIGN PATENT DOCUMENTS

| | | |
|---|---|---|
| DE | 1787924 U | 4/1959 |
| DE | 3401855 | 7/1985 |
| DE | 3834924 A1 | 4/1990 |
| EP | 0497301 A2 | 8/1992 |
| FR | 1331706 A | 7/1963 |

OTHER PUBLICATIONS

International Searching Authority, International Search Report and Written Opinion, International Application No. PCT/US13/63057, mailed Jul. 11, 2014, 12 pp.

* cited by examiner

*Primary Examiner* — G. Bradley Bennett
(74) *Attorney, Agent, or Firm* — Wood Herron & Evans LLP

(57) ABSTRACT

A reticle piece for use in an optical sight includes a generally cylinder-shaped body having a front face and a back face opposed therefrom. The reticle piece includes a reticle pattern and a level indicating device positioned between the front face and the back face of the body. The level indicating device includes a moveable leveling indicator.

18 Claims, 8 Drawing Sheets

RETICLE PIECE HAVING LEVEL INDICATING DEVICE

RELATED APPLICATIONS

This application claims the benefit of U.S. Provisional Application No. 61/708,731, filed Oct. 2, 2012, the content of which is incorporated by reference herein in its entirety.

FIELD OF THE INVENTION

The present invention generally relates to sight devices, such as optical sights. More particularly, the invention relates to a reticle piece for an optical sight having a level indicating device.

BACKGROUND

Sight devices are commonly used with firearms to provide a shooter with an aiming point. Several types of sight devices are available. For example, iron sights typically include a first sight piece positioned near the muzzle end of a firearm and a second sight piece positioned nearer to the breach end. The first and second sight pieces are positioned appropriately with respect to one another to align the firearm with a target.

Optical sights are another type of sight device and include optical components, such as lenses, and an indication of an aiming point. Typically, this indication of an aiming point is in the form of a reticle, which can have many configurations, such as dots, crosshairs, and others. Telescopic sights are a type of optical sight and include lenses that magnify the image viewed through the telescopic sight.

A reticle is typically provided in an optical sight by positioning a reticle piece, sometimes referred to as reticle glass, at an appropriate position in the optical components of the optical sight. A reticle piece includes a reticle pattern and is typically positioned at a focal plane so that it provides an in-focus reticle, when viewed by a shooter. For example, telescopic sights typically include a front focal plane and a rear focal plane, and the reticle piece can be positioned at either of those focal planes.

A reticle is a graphic image superimposed over the view seen through an optical sight. A crosshair reticle is a common type of reticle and includes a vertical segment and a horizontal segment which intersect one another in a central region of the view seen through the optical sight. In general, the intersection of the vertical and horizontal segments provides the aiming point that a shooter aligns with a target.

For relatively close targets, the aiming point may coincide with the point that a bullet will impact. In addition, either or both of the vertical and horizontal segments can include additional markings relevant to factors relating to an appropriate aiming point. For example, a vertical segment may include graduated hashes or other marks that correspond with the amount that a bullet will drop (due to gravity) as it follows its trajectory to a distant target. For more distant targets, the aiming point provided by the intersection of the vertical and horizontal segments of the reticle may not coincide with a point of bullet impact unless the aiming point is adjusted to compensate for bullet drop. Generally, as the distance to a target increases, a shooter will have to account for the amount that a bullet will drop. The graduated hashes on the vertical segment of the reticle can assist a shooter in addressing this bullet drop.

If an optical sight is properly leveled with respect to the ground, the bullet drop will follow along the vertical segment of the reticle (assuming there is no cross-wind). If the optical sight is not properly leveled, however, such as if the firearm to which the optical sight is attached is held in a tilted orientation, then the bullet drop will not follow along the vertical segment of the reticle, and the graduated hashes on the vertical segment will not be useful to the shooter.

There is a need, therefore, for devices that provide an indication of whether an optical sight is properly leveled with respect to the ground. Various external devices have been used, but these require the shooter to move his eye away from the view through the optical sight in order to check or confirm the level of the firearm. The shooter must then return his view to the optical sight, but can no longer with the external device. Various electronic devices have been proposed which provide an internally viewed level indicator, but these require a power source and significantly increase the cost of the optical sight. Internal mechanical devices have to be trued to the reticle and are subject to becoming misaligned.

SUMMARY OF THE INVENTION

The present invention overcomes the foregoing problems and other shortcomings and drawbacks of known optical sights. While the present invention will be described in connection with certain embodiments, it will be understood that the present invention is not limited to these embodiments. To the contrary, this invention includes all alternatives, modifications, and equivalents as may be included within the spirit and scope of the present invention.

According to one embodiment of the present invention, a reticle piece for use in an optical sight includes a generally cylinder-shaped body having a front face and a back face opposed therefrom. The reticle piece includes a reticle pattern and a level indicating device positioned between the front face and the back face of the body. The level indicating device includes a moveable leveling indicator.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention. Like parts are identified by like reference numerals throughout the various figures of the drawing, wherein.

DETAILED DESCRIPTION OF THE ILLUSTRATIVE EMBODIMENTS

Referring to the figures, reticle pieces are shown which are generally useful for providing a reticle in an optical sight for a firearm. The reticle pieces are configured to be included with the optical components of an optical sight so that a reticle pattern is superimposed over the view seen through the optical sight. For example, the reticle pieces can be used in telescopic sights, and can be placed in either the first or second focal plane of a telescopic sight, as appropriate or desired.

Figure 1:
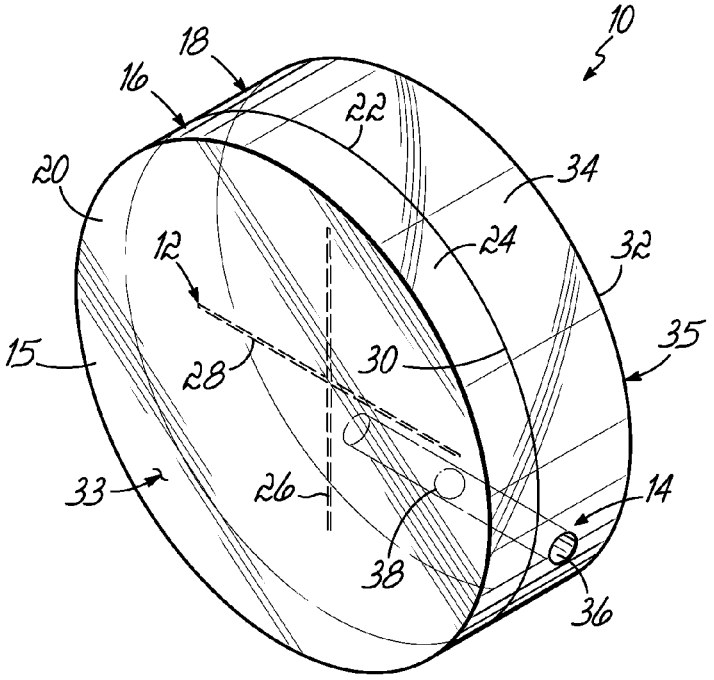
FIG. 1 is an isometric view of a reticle piece constructed according to the concepts of the present invention and including a level indicating device.
Figure 2:
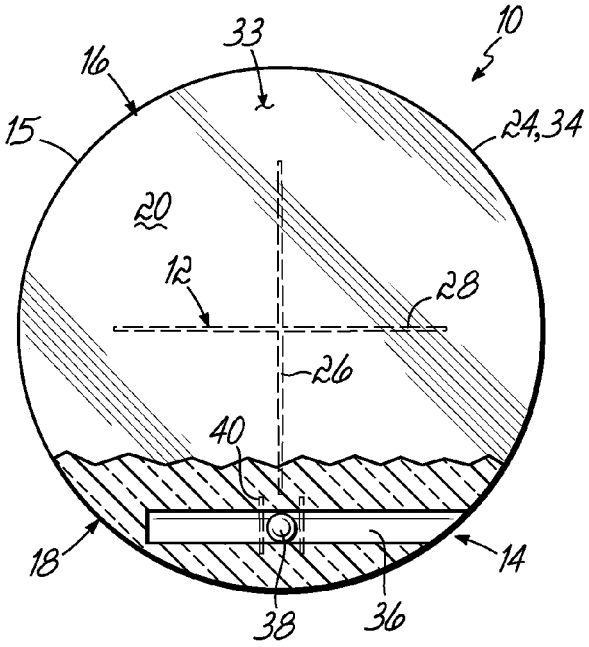
FIG. 2 is a side elevational view of the reticle piece shown in FIG. 1.
Figure 3:
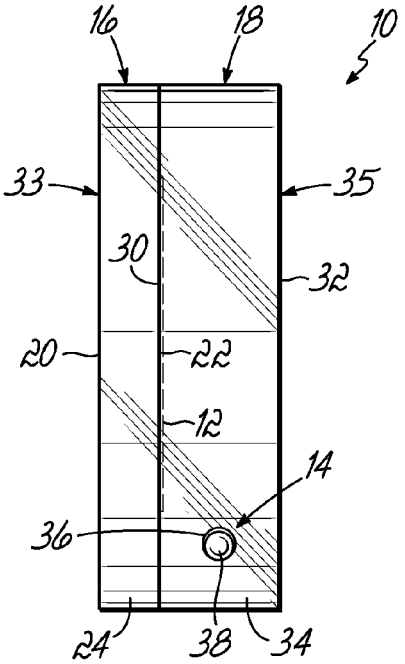
FIG. 3 is a front elevational view of the reticle piece shown in FIG. 1.

Referring first to FIGS. 1-3, a reticle piece is shown and is indicated at 10. The reticle piece 10 is generally cylinder-shaped and made of glass or other transparent material, and includes a reticle pattern 12. The reticle piece 10 includes an integral level indicating device 14. As will become apparent from the following description, the level indicating device 14 provides a shooter with a visual indication of whether the reticle piece 10, and the optical sight/firearm with which the reticle piece 10 is used, are properly leveled.

In the embodiment shown, the reticle piece 10 includes a body 15 having a first portion 16 and a second portion 18. As shown, the first portion 16 includes the reticle pattern 12 and the second portion 18 includes the level indicating device 14. Of course, it will be appreciated that a reticle piece could be constructed having a unitary body containing both a reticle pattern and a level indicating device.

The first portion 16 is generally disc-shaped and has opposed faces 20, 22, and a peripheral edge 24. The reticle pattern 12 is formed on the face 22, such as by etching or other well-known techniques. The reticle pattern 12 depicted is merely exemplary, and includes a vertical segment 26 and a horizontal segment 28. The reticle pattern 12 has a crosshair configuration, with the vertical and horizontal segments 26, 28 intersecting generally near the center of the reticle piece 10.

The second portion 18 is also generally disc-shaped and has opposed faces 30, 32, and a peripheral edge 34. The second portion 18 may be positioned adjacent the first portion 16 so the faces 30, 22 contact one another, as shown.

The first and second portions 16, 18 may have generally the same diameter such that the peripheral edges 24, 34 are aligned to provide a continuous outer edge of the reticle piece 10. Also, with the first and second portions 16, 18 positioned adjacent one another as shown, the face 20 provides a front face 33 of the body 15, and the face 32 provides a back face 35 of the body 15 opposed from the front face 33.

The level indicating device 14 may be formed integral with and internal to the reticle piece 10. As shown, the level indicating device 14 is generally between the front face 33 and the back face 35 of the body 15. In the embodiment shown, the body 15 includes an internal void 36 formed in the second portion 18. The void 36 extends transverse to a lengthwise axis of the cylinder-shaped body 15.

As shown, the void 36 may be positioned near a lower region of the second portion 18, so that the level indicating device 14 does not interfere with the reticle pattern 12 (as shown in FIG. 3). The level indicating device 14 includes a moveable leveling indicator 38 positioned in the void 36. The leveling indicator 38 can be a solid object, such as a ball, or may be a bubble in a liquid medium.

In the embodiment shown, the leveling indicator 38 is a small ball that is free to roll within the void 36. The ball may be approximately 1 mm in diameter and the void 36 approximately 1.04 mm in diameter. When the reticle piece 10 is level, the leveling indicator 38 will be positioned in the center of the void 36 (as shown in FIG. 3). Indicia 40 may be included for marking the position of the leveling indicator 38 when the device is level. If the reticle piece 10 is not level, the leveling indicator 38 will move away from the center of the void 36 and away from the indicia 40, providing a shooter with an indication that the reticle piece 10 (and therefore the optical sight) is not level. The indicia 40 may be considered part of the level indicating device 14. If desired, additional indicia (not shown) indicating gradation units of tilt, such as in degrees, may be included as well.

In other embodiments, the level indicating device 14 could be in the form of a bubble level, in which case the moveable leveling indicator 38 would be a bubble that is moveable but trapped within a liquid in the void 36.

The void 36 may be formed in any appropriate manner. For example, it may be formed by drilling or other means of cutting the glass or other material of the body 15 part way or all the way therethrough. Alternatively, a groove or channel may be formed in the face 30 of the second portion 18 and then closed by the face 22 of the first portion 16 to form a chamber when the two reticle portions 16, 18 are brought together. Alternatively, a groove or channel formed in the face 30 of the second portion 18 may be closed by applying a separate closure part or layer to the second portion 18. The void 36 may be closed and sealed after the leveling indicator 38, whether a ball or liquid and bubble, is inserted therein. This closure may be of one or both exposed ends of a partial or through-drilled void and may be in the form of a solid plug or curable material.

The void 36 may be formed in any desired and functionally appropriate shape. For example, and as shown, the void 36 can have a generally straight-line shape, extending across the second section 18 generally parallel with the horizontal segment 28 of the reticle pattern 12 (as shown in FIG. 2). In other embodiments, the void 36 can have an upwardly or downwardly curved or arcuate shape (not shown), such as to provide a centrally-located point where the leveling indicator 38 (whether a ball or a bubble) will rest when the device is level and from which the leveling indicator 38 will move if the reticle piece 10 is tilted to move the leveling indicator 38 away from the indicia 40. Thus, the shape of the void 36 can be chosen to assist in providing an indication of whether the reticle piece 10 is level and to avoid having the leveling indicator 38 be stuck and lag when the position is moved only slightly.

Moreover, the void 36 may have any appropriate profile. As shown in FIGS. 1 and 3, the void 36 has a generally round profile, but other shapes are also possible.

Referring next to FIGS. 4-7, a reticle piece according to another embodiment of the invention is shown and is indicated at 50. The reticle piece 50 is generally cylinder-shaped and made of glass or other transparent material, and includes a reticle pattern 52 and a level indicating device 54.

Figure 7:
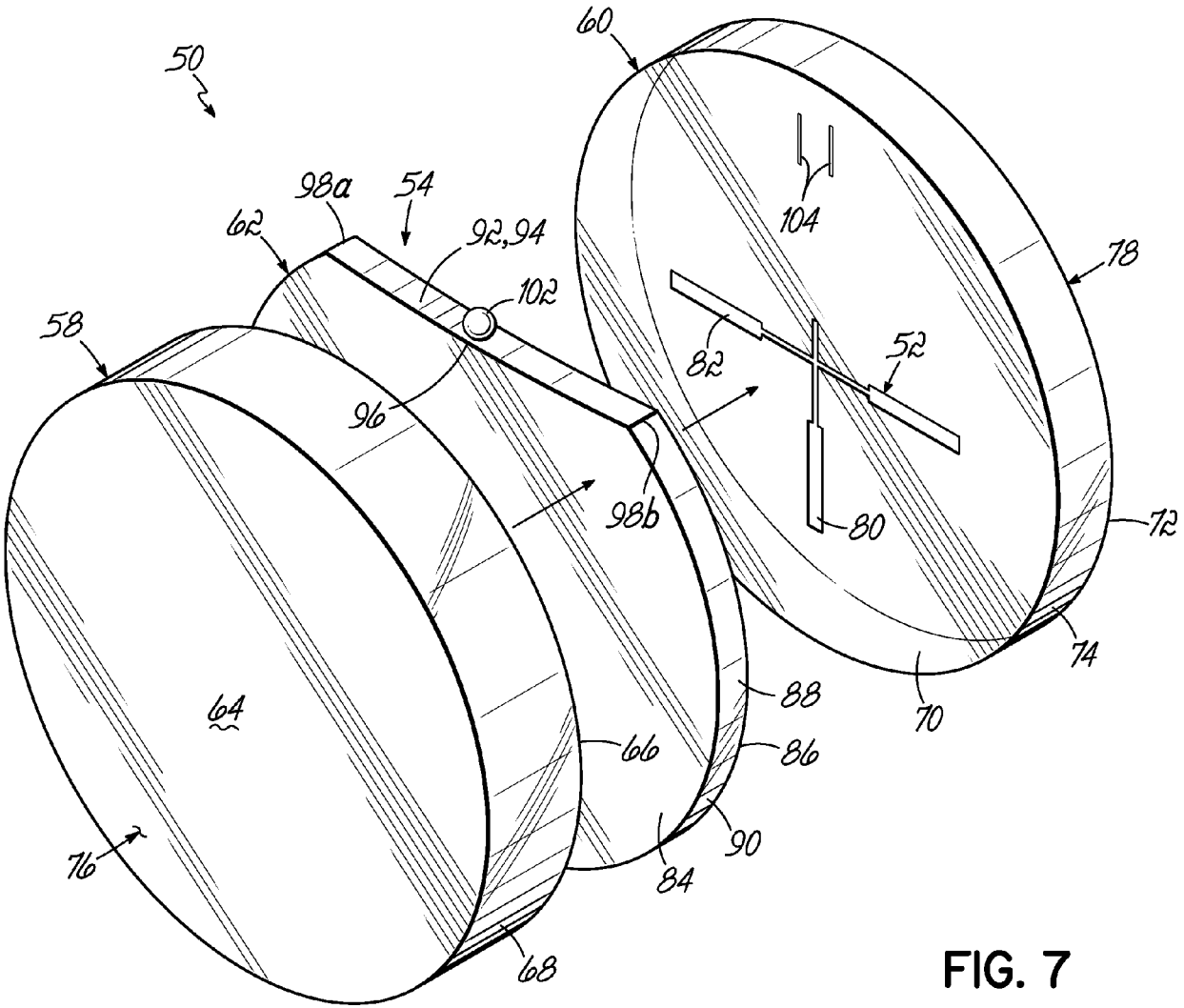
FIG. 7 is an exploded isometric view of the reticle piece shown in FIG. 4.

The reticle piece 50 has a body 56 that includes a first portion 58, a second portion 60, and a spacer plate 62 positioned between the first and second portions 58, 60. As shown in FIG. 7, the first portion 58, second portion 60, and spacer plate 62 are separate components that are combined to form the body 56, but it will also be appreciated that the reticle piece 50 could be constructed having a unitary body.

The first portion 58 is generally disc-shaped and has opposed faces 64, 66, and a peripheral edge 68. The second portion 60 is also generally disc-shaped and has opposed faces 70, 72, and a peripheral edge 74. The opposed faces 64, 72 provide a front face 76 and a back face 78, respectively, of the body 56. The peripheral edges 68, 74 have generally the same shape.

As shown in FIG. 7, the reticle pattern 52 is formed on the face 70 of the second portion 60, by etching or other well-known techniques. The reticle pattern 52 depicted is merely exemplary, and includes a vertical segment 80 and a horizontal segment 82. In the embodiment shown, the reticle pattern 52 has a duplex crosshair configuration, with the vertical and horizontal segments 80, 82 thinning out near their point of intersection.

Figure 5:
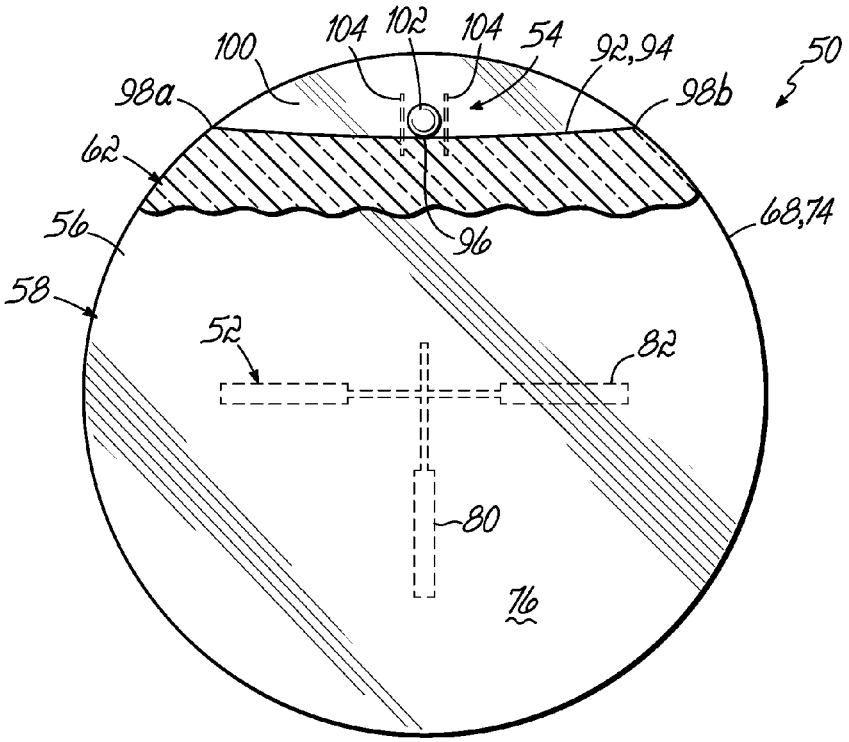
FIG. 5 is a front elevational view of the reticle piece shown in FIG. 4.

The spacer plate 62 is partially disc-shaped, and includes opposed faces 84, 86, and a peripheral edge 88. The peripheral edge 88 has a generally round first portion 90 that is similar in shape to parts of the peripheral edges 68, 74 of the first and second portions 58, 60. The spacer plate 62 includes an upper surface 92 that defines a slightly curved second portion 94 of the peripheral edge 88. As shown in FIG. 5, the upper surface 92 has a slight curve, with a low point 96 generally near a center region of the upper surface 92, and high points 98*a*, 98*b* generally near the intersection of the upper surface 92 with the first portion 90 of the peripheral edge 88. The upper surface 92 has a generally flat profile, as shown in FIG. 6.

Figure 4:
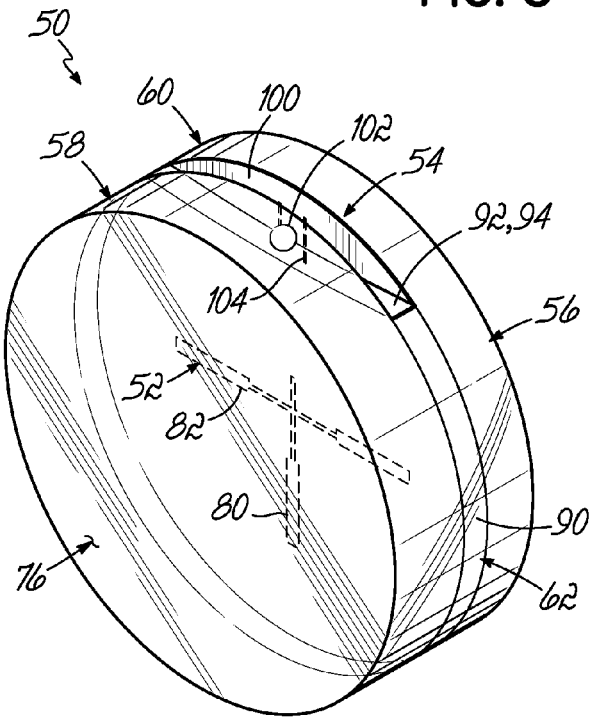
FIG. 4 is an isometric view of a reticle piece constructed according to another embodiment of the invention and including a level indicating device having a rolling ball.
Figure 6:
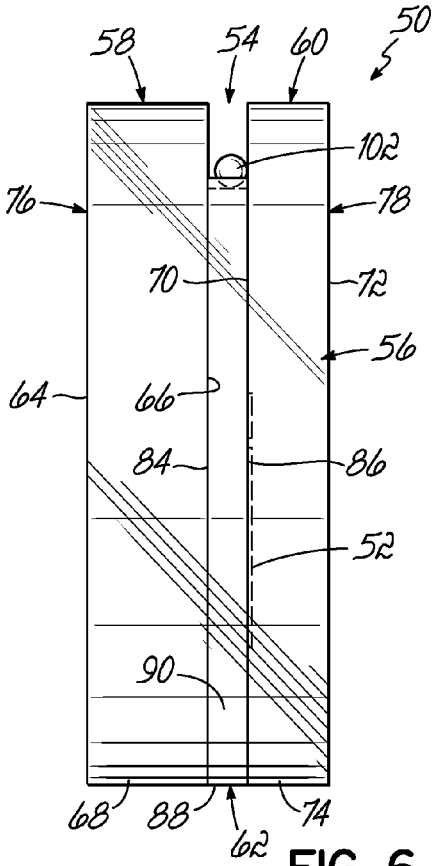
FIG. 6 is a side elevational view of the reticle piece shown in FIG. 4.

In the assembled configuration shown in FIGS. 4-6, the body 56 has an internal void 100 formed between the first and second portions 58, 60. In particular, the void 100 is defined in the space between the first and second portion 58, 60 above the upper surface 92 of the spacer plate 62. The void 100 extends transverse to a lengthwise axis of the generally cylinder-shaped body 56.

The level indicating device 54 may be formed integral with and internal to the reticle piece 50. As shown, the level indicating device 54 is generally between the front face 76 and the back face 78 of the body 56. The level indicating device 54 includes a moveable leveling indicator 102 positioned in the void 100. In particular, the leveling indicator 102 may be a ball that is configured to roll along the upper surface 92. The ball 102 may be constructed of any suitable material, and in some embodiments is constructed of glass, allowing it to be illuminated with the reticle, if desired. As shown, the void 100 may be positioned near an upper region of the body 56, so that the level indicating device 54 does not interfere with the reticle pattern 52 (as shown in FIG. 5).

As shown in FIG. 6, the spacer plate 62 has a thickness in the lengthwise dimension of the generally cylinder-shaped body 56 that allows the ball 102 to freely move within the void 100. When the reticle piece 50 is level, the ball 102 will be positioned in the center of the upper surface 92 (as shown in FIG. 5). Indicia 104 may be included for marking the position of the ball 102 when the device is level (as well as degrees of cant or tilt if desired). As shown, the indicia 104 is formed on or applied to the face 70 of the second portion 60. If the reticle piece 50 is not level, the ball 102 will move away from the center of the upper surface 92 and away from the indicia 104, providing a shooter with an indication that the reticle piece 50 (and, therefore, the optical sight) is not level. The indicia 104 may be considered part of the level indicating device 54 and may be formed in the same way the reticle is formed, allowing it to be illuminated, if desired.

Turning next to FIGS. 8A-10C, various spacer plates are shown that can be used in conjunction with a reticle piece, such as the reticle piece 50.

Figure 8A:
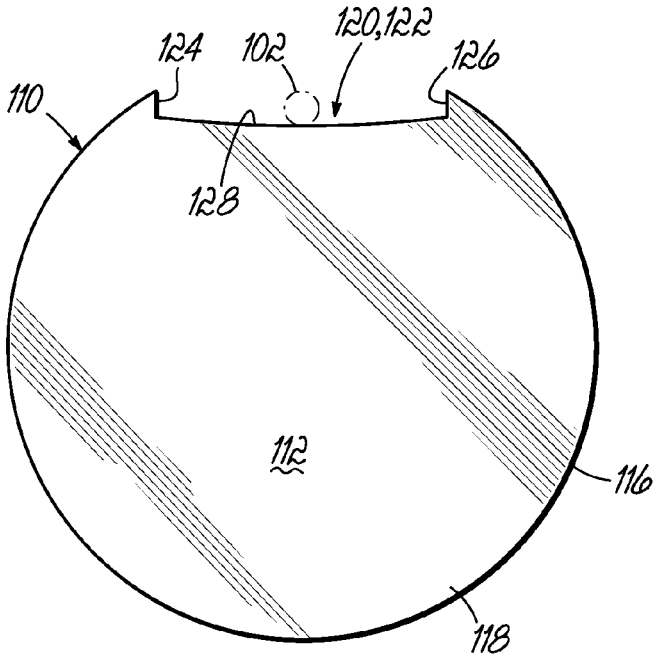
FIG. 8A is an isometric view of a spacer plate for a reticle piece according to another embodiment of the invention.
Figure 8B:
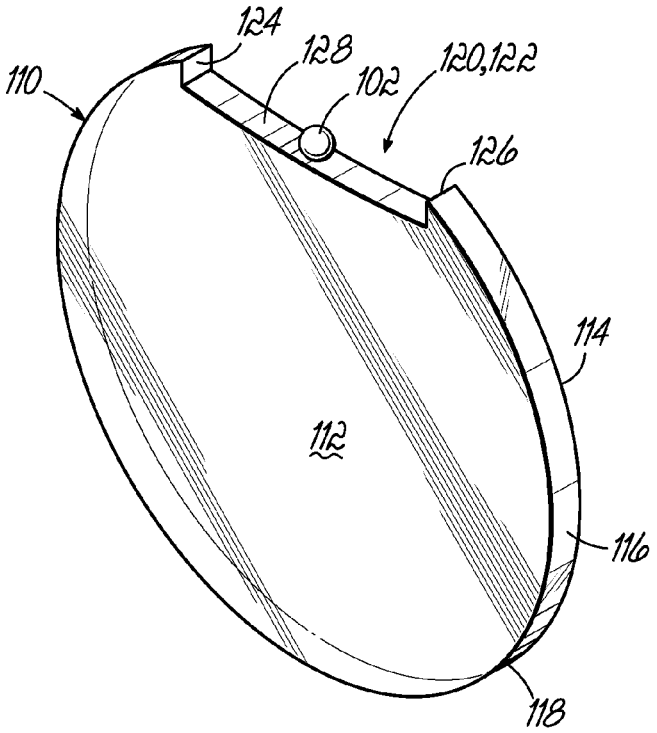
FIG. 8B is a front elevational view of the spacer plate shown in FIG. 8A.

FIGS. 8A and 8B show a spacer plate 110 that is partially disc-shaped, and includes opposed faces 112, 114, and a peripheral edge 116. The peripheral edge 116 has a generally round first portion 118 that is similar in shape to parts of the peripheral edges 68, 74 of the first and second portions 58, 60, as those portions are shown in FIGS. 4-7.

The spacer plate 110 includes a well 120 that defines a second portion 122 of the peripheral edge 116. The well 120 includes sidewalls 124, 126 and a bottom wall 128 extending between the sidewalls 124, 126. The sidewalls 124, 126 generally intersect with the bottom wall 128 at an angle, which in the embodiment shown is approximately 90°. The bottom wall 128 may have a slight curve, similar to the upper surface 92 described above. As shown, the bottom wall 128 has a generally flat profile.

Movement of a leveling indicator, such as a ball, with the spacer plate 110 would be confined within the well 120. In particular, the leveling indicator could move along the bottom wall 128, and the sidewalls 124, 126 would provide stops to limit the side-to-side travel of the leveling indicator. These physical stops do not necessarily have to be an integral part of the glass spacer plate, but other mechanical means may be employed to achieve the same intended purpose, such as a rubber plug or other material affixed between the plates at the ends of the curved radii of the bottom wall 128. This would achieve the same purpose and may reduce manufacturing/fabrication costs.

Figure 9A:
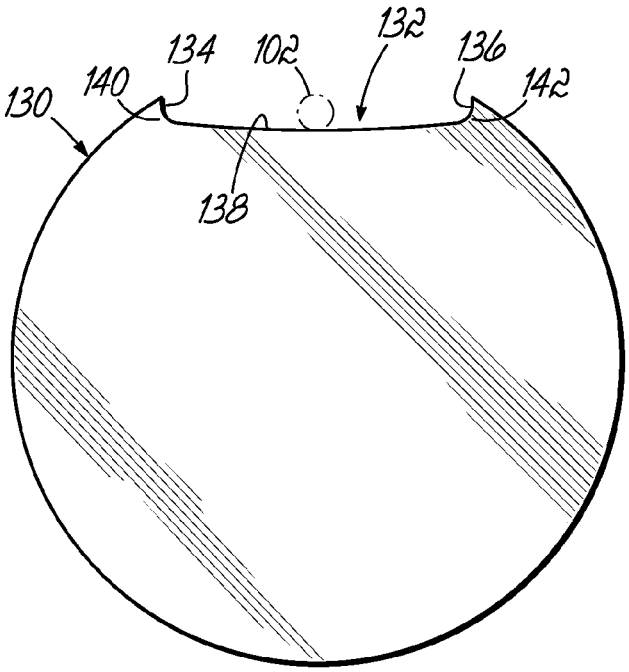
FIG. 9A is an isometric view of a spacer plate for a reticle piece according to another embodiment of the invention.
Figure 9B:
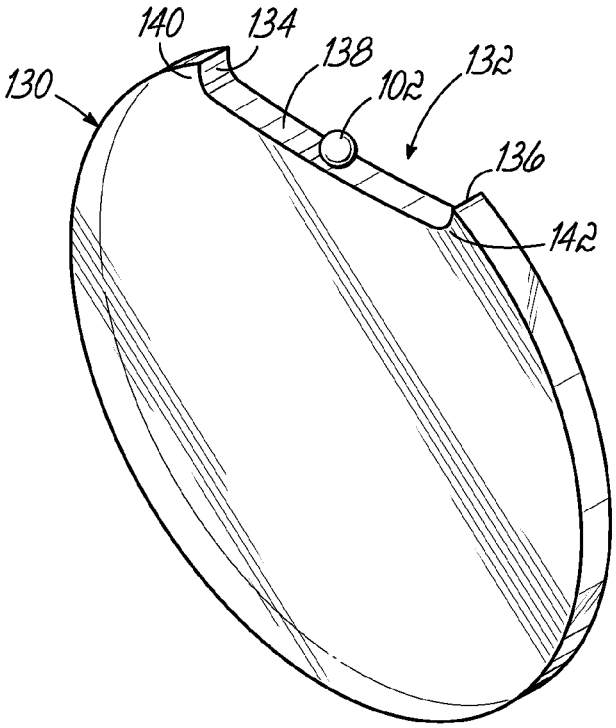
FIG. 9B is a front elevational view of the spacer plate shown in FIG. 9A.

FIGS. 9A and 9B show a spacer plate 130 that is substantially similar to the spacer plate 110, except that the spacer plate 130 includes a well 132 having sidewalls 134, 136 that intersect with a bottom wall 138 through curved radius sections 140, 142, respectively.

Movement of a leveling indicator, such as a ball, with the spacer plate 130 would be confined within the well 130. In particular, the leveling indicator could move along the bottom wall 138, and the sidewalls 134, 136 would provide stops to limit the side-to-side travel of the leveling indicator. The curved radius sections 140, 142 would provide control over stopping the leveling indicator as it reaches the sidewalls 134, 136.

Figure 10A:
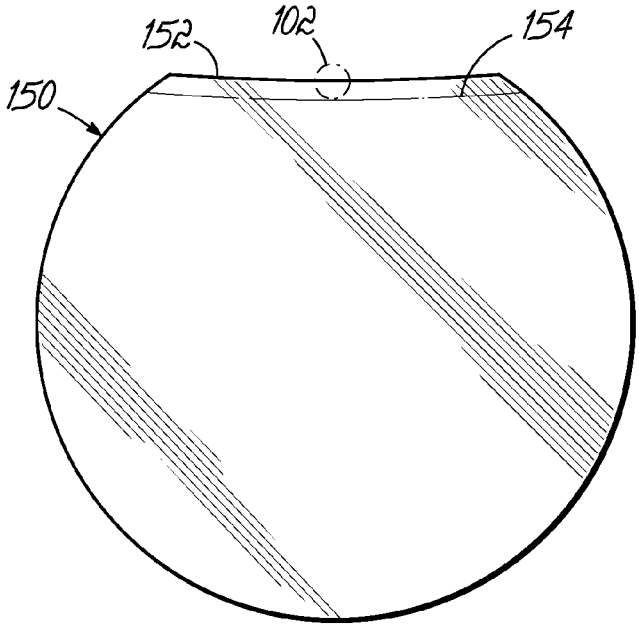
FIG. 10A is an isometric view of a spacer plate for a reticle piece according to another embodiment of the invention.
Figure 10B:
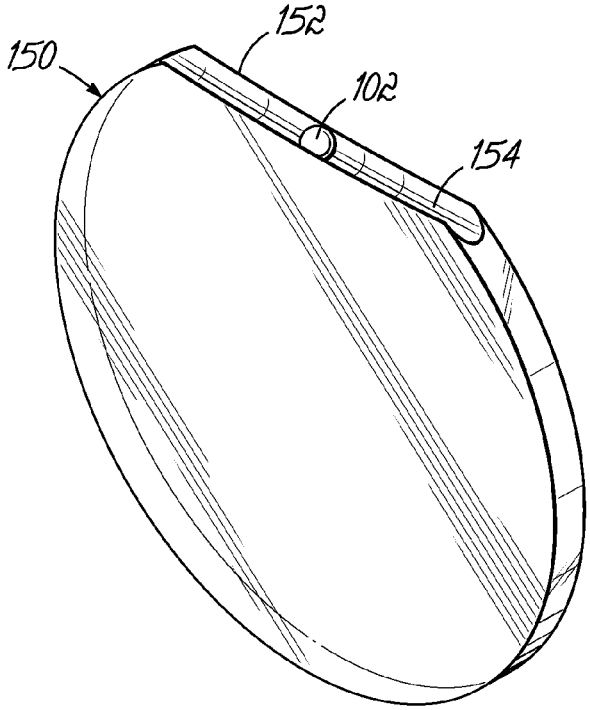
FIG. 10B is a front elevational view of the spacer plate shown in FIG. 10A.
Figure 10C:
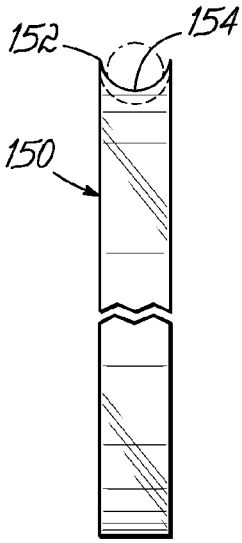
FIG. 10C is a side elevational view of the spacer plate shown in FIG. 10A.
Figure 12:
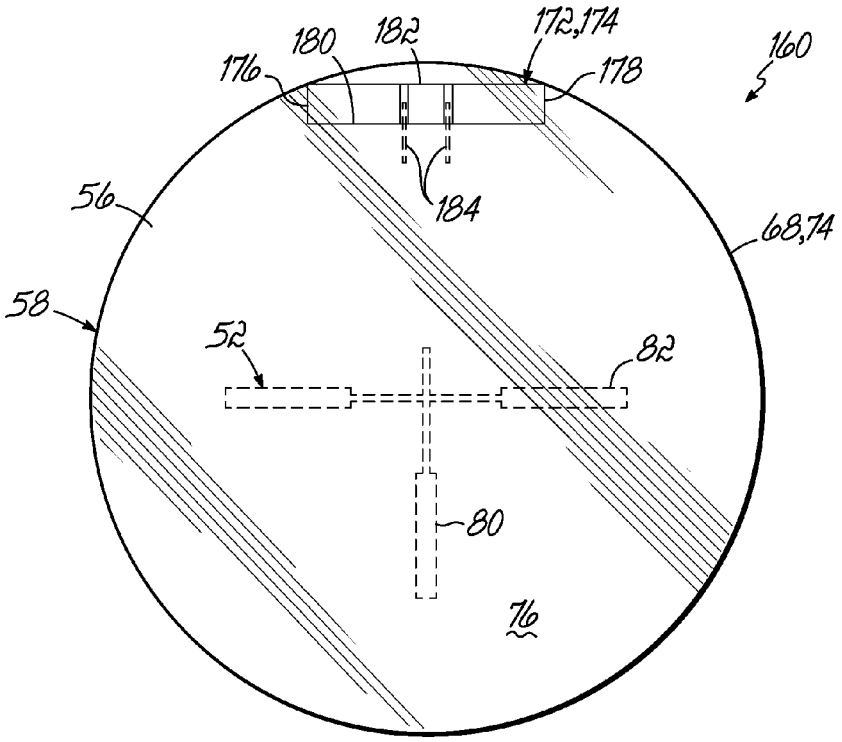
FIG. 12 is a front elevational view of the reticle piece shown in FIG. 11.
Figure 11:
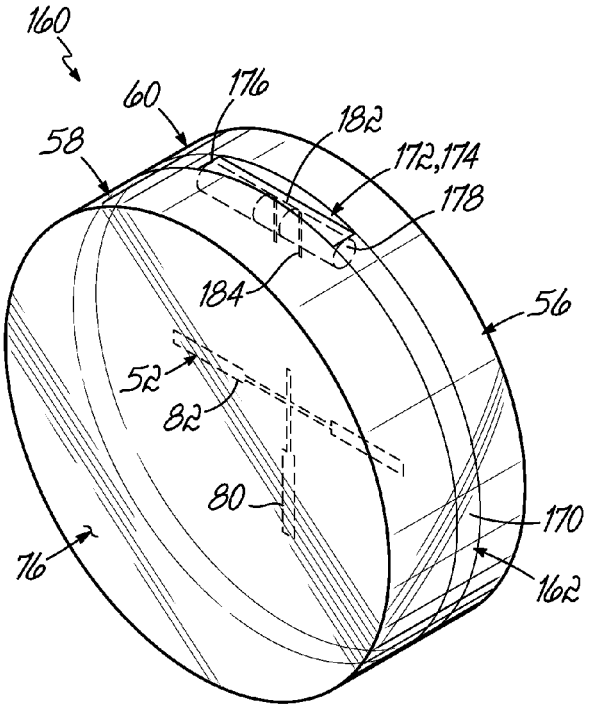
FIG. 11 is an isometric view of a reticle piece constructed according to another embodiment of the invention and including a level indicating device having a moveable bubble.
Figure 13:
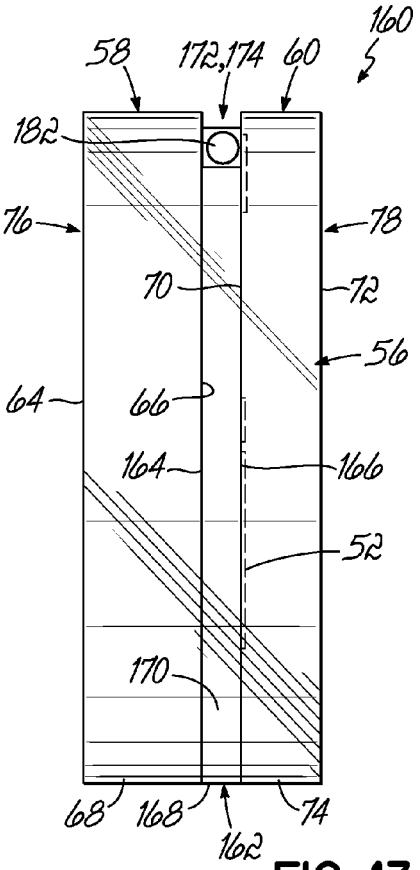
FIG. 13 is a side elevational view of the reticle piece shown in FIG. 11.
Figure 14:
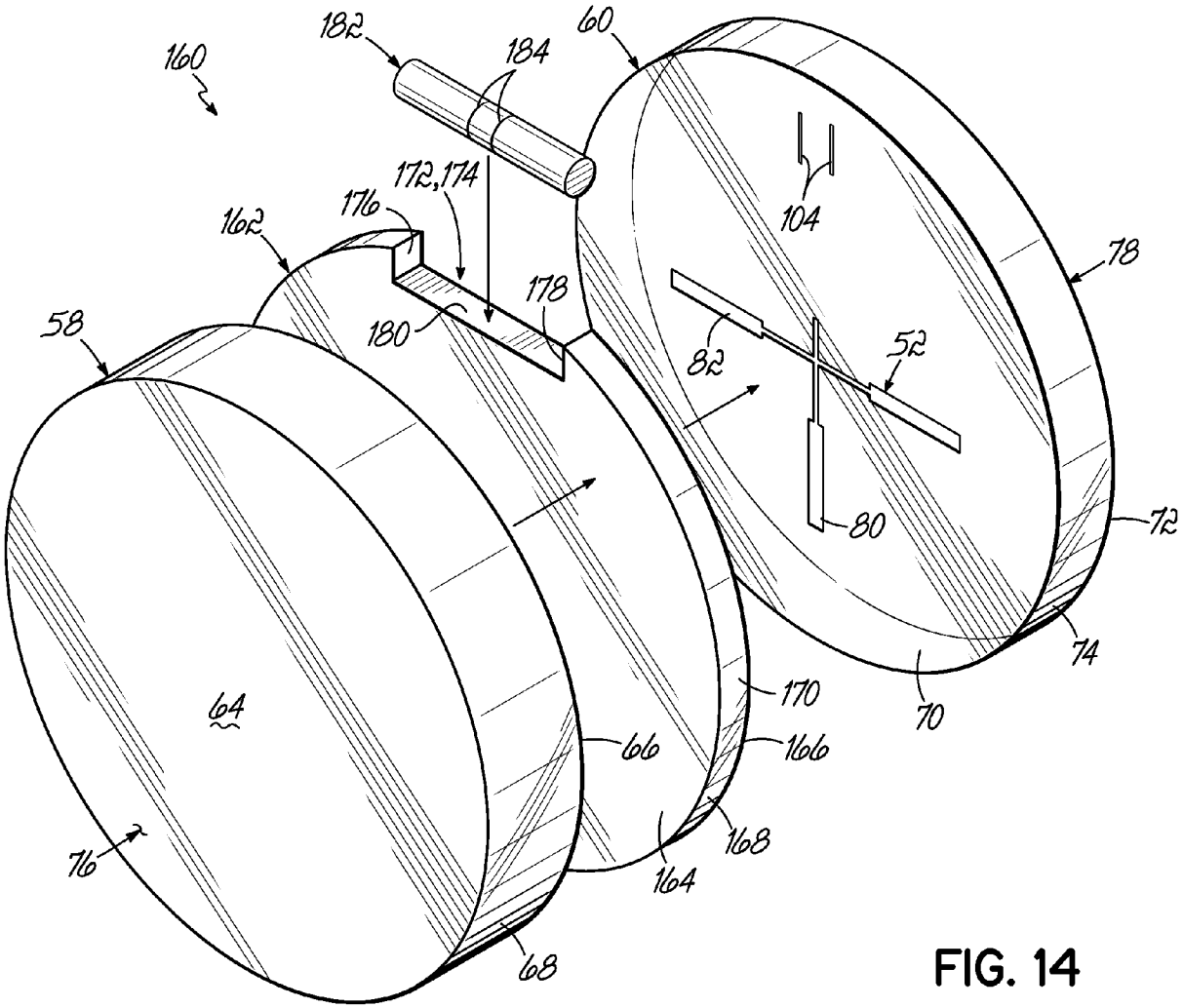
FIG. 14 is an exploded isometric view of the reticle piece shown in FIG. 11.

FIGS. 10A-10C show a spacer plate 150 that is substantially similar to the spacer plate 62, except that the spacer plate 150 includes an upper surface 152 having a generally curved channeled profile, as shown in FIG. 10C. In particular, the curve of the profile opens generally upwardly and provides a grooved channel or track 154 in which a leveling indicator, such as a ball, could move. As shown, the track 154 has a generally curved concave radius or channel formed in the upper surface 152 of the spacer plate 150.

Referring next to FIGS. 11-14, a reticle piece 160 is shown that is generally similar to the reticle piece 50, except for the spacer plate and the level indicating device. In FIGS. 11-14, a spacer plate 162 is used in conjunction with first and second portions 58, 60, as those features are described above and shown in FIGS. 4-7.

The spacer plate 162 is partially disc-shaped, and includes opposed faces 164, 166, and a peripheral edge 168. The peripheral edge 168 has a generally round first portion 170 that is similar in shape to parts of the peripheral edges 68, 74 of the first and second portions 58, 60.

The spacer plate 110 includes a well 172 that defines a second portion 174 of the peripheral edge 116. The well 172 includes sidewalls 176 or other mechanical means (not shown), 178 and a bottom wall 180 extending between the sidewalls 176, 178. The well 172 is configured to receive a level indicating device in the form of a bubble level vial 182 according to well-known construction. Advantageously, the well 172 may be configured to limit movement of the bubble level vial 182 when it is in the well 172.

The bubble level vial 182 is generally conventional and includes a gas bubble trapped in a liquid medium. When the reticle piece 160 is level, the bubble will be positioned in the center of the bubble level vial 182. Indicia 184 may be included for marking the position of the bubble when the device is level. As shown, the indicia 184 may be formed on the face 70 of the second portion 60, or on the bubble level vial 182. If the reticle piece 160 is not level, the bubble will move away from the center of the bubble level vial 182 and away from the indicia 184, providing a shooter with an indication that the reticle piece 160 (and therefore the optical sight) is not level. If desired, additional indicia (not shown) indicating gradation units of tilt, such as in degrees, may be included as well.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A reticle piece for use in an optical sight, comprising:
- a generally cylinder-shaped body including:
  - a generally disc-shaped first portion having a front face,
  - a generally disc-shaped second portion having a back face disposed opposite the front face, and
  - a void extending generally transverse to the lengthwise axis of the body, the void being non-parallel to a peripheral edge of the body,
- a reticle pattern on the body, and
- a level indicating device including a moveable leveling indicator positioned in the void between the front face and the back face.

2. The reticle piece of claim 1, wherein the moveable leveling indicator includes a ball.

3. The reticle piece of claim 1, wherein the moveable leveling indicator includes a bubble trapped in a liquid.

4. The reticle piece of claim 1, wherein the void is formed entirely in one of the first and second portions.

5. The reticle piece of claim 1, wherein the first portion includes the reticle pattern and the second portion includes the void.

6. A reticle piece for use in an optical sight, comprising:
- a generally cylinder-shaped body including:
  - a generally disc-shaped first portion having a front face,
  - a generally disc-shaped second portion having a back face disposed opposite the front face, and
  - a spacer plate positioned between the first and second portions, the spacer plate including an upper surface that forms a void above the spacer plate between the first and second portions, the void extending generally transverse to the lengthwise axis of the generally cylinder-shaped body,
- a reticle pattern on the body, and
- a level indicating device including a moveable leveling indicator positioned in the void, the moveable leveling indicator comprising a ball configured to roll along the upper surface.

7. The reticle piece of claim 6, wherein the upper surface has a generally flat profile.

8. The reticle piece of claim 6, wherein the upper surface includes a generally channeled profile.

9. The reticle piece of claim 6, wherein the upper surface of the spacer plate includes a well having sidewalls and a bottom wall, and the moveable leveling indicator comprises a ball configured to roll along the bottom wall.

10. The reticle piece of claim 9, wherein the sidewalls intersect the bottom wall at an angle.

11. The reticle piece of claim 9, wherein the sidewalls intersect the bottom wall through respective curved radius sections.

12. A reticle piece for use in an optical sight, comprising:
- a generally cylinder-shaped body including:
  - a generally disc-shaped first portion having a front face,
  - a generally disc-shaped second portion having a back face disposed opposite the front face, and
  - a spacer plate positioned between the first and second portions, the spacer plate including a void above the spacer plate between the first and second portions, the void extending generally transverse to the lengthwise axis of the generally cylinder-shaped body, the spacer plate includes a well having sidewalls and a bottom wall,
- a reticle pattern on the body, and
- a level indicating device including a bubble level vial positioned in the well.

13. The reticle piece of claim 6, wherein the reticle piece further includes indicia marking a position of the moveable leveling indicator when the reticle body is level.

14. The reticle piece of claim 13, wherein the indicia is formed on the body.

15. The reticle piece of claim 13, wherein the indicia further indicates gradation units of tilt.

16. The reticle piece of claim 15, wherein the gradation units include degrees of tilt.

17. The reticle piece of claim 1, wherein the void extends completely through the body.

18. The reticle piece of claim 1, wherein the void extends part way through the body.

* * * * *